US012532971B2

(12) United States Patent
Massimo

(10) Patent No.: US 12,532,971 B2
(45) Date of Patent: Jan. 27, 2026

(54) HEIGHT-ADJUSTABLE BED

(71) Applicant: CIAR S.P.A., Pesaro (IT)

(72) Inventor: Carrera Massimo, Tavullia (IT)

(73) Assignee: CIAR S.P.A., Pesaro (IT)

( * ) Notice: Subject to any disclaimer, the term of this patent is extended or adjusted under 35 U.S.C. 154(b) by 70 days.

(21) Appl. No.: 18/583,092

(22) Filed: Feb. 21, 2024

(65) Prior Publication Data

US 2024/0315458 A1 Sep. 26, 2024

(30) Foreign Application Priority Data

Mar. 20, 2023 (DE) ..... 202023101386.4

(51) Int. Cl.
*A47C 19/04* (2006.01)
*A47C 19/02* (2006.01)

(52) U.S. Cl.
CPC ..... *A47C 19/045* (2013.01); *A47C 19/021* (2013.01)

(58) Field of Classification Search
CPC ..... A47C 19/045; A61G 7/012
See application file for complete search history.

(56) References Cited

U.S. PATENT DOCUMENTS

| | | | | |
|---|---|---|---|---|
| 5,020,173 A * | 6/1991 | Dreyer, Jr. | ..... | A47C 17/86 297/188.1 |
| 2016/0331146 A1* | 11/2016 | Ray | ..... | A47C 19/045 |
| 2017/0251817 A1* | 9/2017 | Atkinson, Jr. | ..... | A47C 19/025 |
| 2022/0175148 A1 | 6/2022 | Huizhou | | |

FOREIGN PATENT DOCUMENTS

| | | | | |
|---|---|---|---|---|
| DE | 19915431 | 10/2000 | | |
| ES | 1072663 U * | 8/2010 | ..... | A47C 19/045 |
| ES | 1225955 U * | 3/2019 | ..... | A47C 19/045 |
| FR | 2773964 A3 * | 7/1999 | ..... | A47C 19/045 |
| JP | H1023944 A * | 1/1998 | ..... | A47C 19/045 |
| WO | WO-2009021281 A1 * | 2/2009 | ..... | A61G 7/012 |

* cited by examiner

*Primary Examiner* — Eric J Kurilla
(74) *Attorney, Agent, or Firm* — Renner, Kenner, Greive, Bobak, Taylor & Weber

(57) ABSTRACT

A bed includes a bed frame supported, in a starting position, via bed legs on a standing surface. A lifting device for lifting the bed between the starting position and a high position, has pivot mechanisms arranged on opposing sides of the bed frame, each provided with a lower frame part, an upper frame part mounted on the bed frame, and two levers pivotably connected to both the lower and upper frame part in the manner of a parallelogram mechanism. The lifting device includes at least one electric actuator for actuating the pivot mechanisms. In the starting position, the pivot mechanisms have no contact with the standing surface, while they are supported on the standing surface in the high position and hold the bed frame including the bed legs at a distance from the standing surface.

12 Claims, 7 Drawing Sheets

HEIGHT-ADJUSTABLE BED

The invention relates to a height-adjustable bed.

Height-adjustable beds are used, in particular, in the care sector. For example, EP 1 737 409 B1 discloses a care bed which has a multi-part mattress pad and a height-adjustable bed lifter, wherein the bed has a subframe standing on the floor and a lifter head on which the mattress pad is arranged. Furthermore, a lever mechanism is provided which connects the subframe to the lifter head.

Furthermore, a mechanism is known from EP 2 901 895 B1 for lifting a slatted frame against a bed frame or base resting on the floor. The mechanism has a first and a second lever arm, wherein one of the two arms is telescopically extendable. Both arms are mounted parallel to one another and fastened on hinges to the frame and the slatted frame in order to form a multipart parallelogram so that the slatted frame can be raised between two positions and held substantially horizontally. In this way, the bed base is easily accessible for stowing goods.

During the cleaning of hotel rooms, one of the tasks is to make the bed. For this purpose, the cleaning personnel must work in a bent position, which is taxing on the body and, in particular, the back. Cleaning of the floor surfaces located under the bed is also relatively laborious, since the beds are relatively heavy and can only be displaced with difficulty.

The invention was therefore based on the object of facilitating the activity of making the bed and cleaning the floor surfaces under the bed.

According to the invention, this object is achieved by the features of claim 1.

The bed according to the invention has a bed frame which, in a starting position of the bed, is supported via bed legs on a standing surface. Furthermore, a lifting device for lifting the bed between the starting position and a high position is provided, which lifting device has pivot mechanisms arranged on opposing sides of the bed frame, which each are provided with a lower frame part, an upper frame part mounted on the bed frame, and two levers pivotably connected to the lower frame part and the upper frame part, wherein the lower frame part, the upper frame part and the two levers are pivotably connected to one another in the manner of a parallelogram mechanism, and the lifting device comprises at least one electric actuator for actuating the pivot mechanisms. In the starting position of the bed, the pivot mechanisms do not have any contact with the standing surface, while they are supported on the standing surface in the high position and hold the bed frame including the bed legs at a distance from the standing surface.

The lifting device according to the invention facilitates the activity of making the bed and the cleaning of the floor surfaces under the bed. In addition, an extremely compact design results, which can easily be integrated into existing bed structures.

Further embodiments of the invention are the subject matter of the dependent claims.

In a preferred exemplary embodiment, the lower frame part of the pivot mechanisms is equipped with wheels which are in rolling contact with the standing surface in a rolling position of the lifting device, while the bed legs are lifted off the standing surface. As a result, the bed can be displaced comparatively easily on the wheels in order, for example, to clean the floor areas located under the bed or to position the bed differently.

In a further embodiment, the two levers of the two pivot mechanisms can each be connected to the lower frame part at an associated articulation point such that one end region each of the levers protrudes beyond the associated articulation point and the length of these end regions is dimensioned such that the bed is supported on the standing surface via the end regions of the levers in the high position. This ensures that the bed is supported in the high position with a relatively small footprint, so that the floor areas located under the bed are easily accessible. In the high position, the end regions of the levers also ensure a safe state, since they lift the lower frame part and thus also the possibly present wheels from the standing surface during the movement into the high position.

According to a further embodiment of the invention, the bed frame is designed for inserting a slatted frame and/or a mattress, wherein the pivot mechanisms are fastened to the bed frame below the mattress, so that they are covered by the mattress. This also has the advantage that the risk of injury during the lifting or lowering of the bed is minimized.

The bed may also be equipped with a bed base below the mattress and a mattress lifting device for lifting the mattress. This has the advantage that the space below the bed can be used for storing objects, in particular, bed linens or additional blankets, and easy access is ensured.

To increase the stability of the lifting device in the high position, the two lower frame parts of the two pivot mechanisms can be connected to one another via cross members. An embodiment in which the two pivot mechanisms are completely covered by the bed frame in the starting position of the bed is particularly attractive (in side view).

In the tests on which the invention is based, it has been proven to be space-saving and particularly effective for transmitting the forces if the electric actuator is designed as an electric linear motor which is arranged between one of the two levers and the lower or upper frame part. Furthermore, it is advantageous if each of the two pivot mechanisms is equipped with a dedicated electric actuator in order to ensure a uniform lifting or lowering of both sides.

For controlling the at least one electric actuator, at least one switch is expediently provided on the bed, in particular, in the region of the bed frame. In the region of the switch, a connection for connecting a power source can furthermore be provided, so that an unintentional operation, for example by a hotel guest, is ruled out. The power source can be, for example, a battery or a power cable. Instead of a switch provided on the bed, controlling by means of a remote control would also be conceivable within the scope of the invention. In principle, a simple switch can be provided for adjusting the height of the bed. However, since the rolling position is not so easily adjustable, three independent switches for the starting position, the rolling position, and the high position are advantageous.

Further embodiments of the invention are explained in more detail with reference to the following description.

Figure 4:
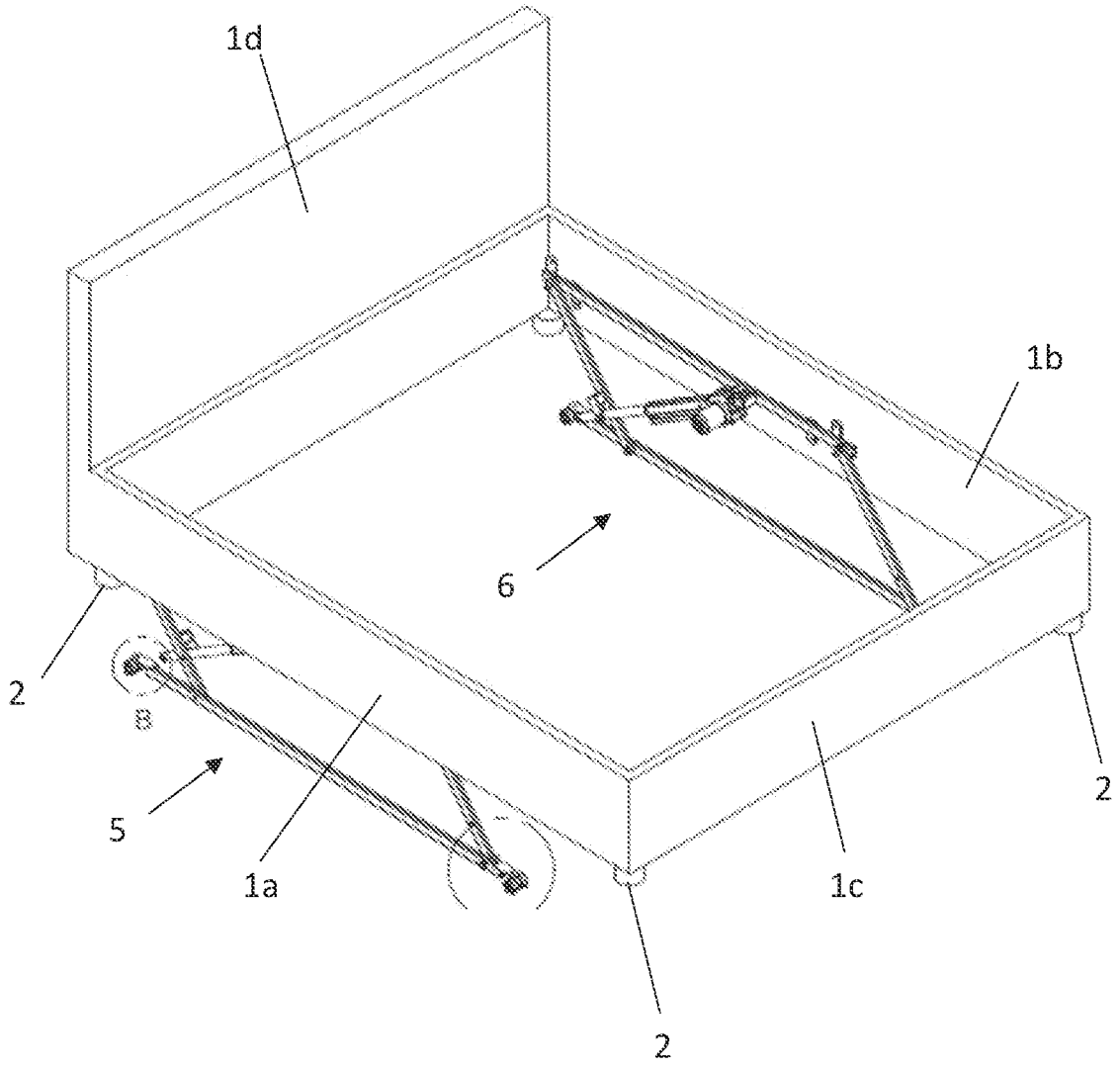
Figure 5:
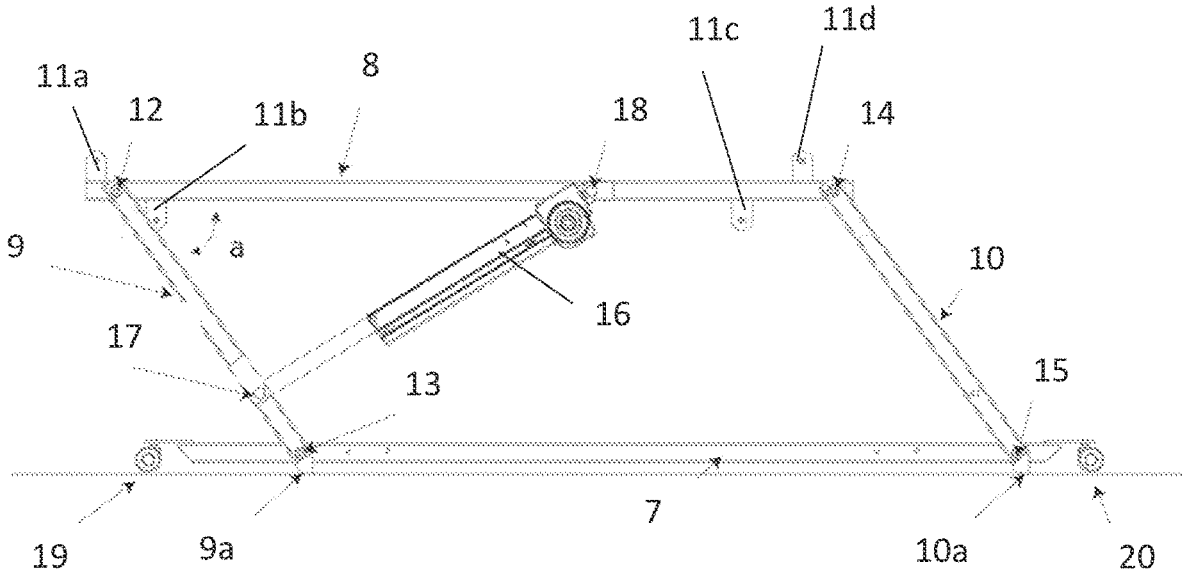
Figure 6:
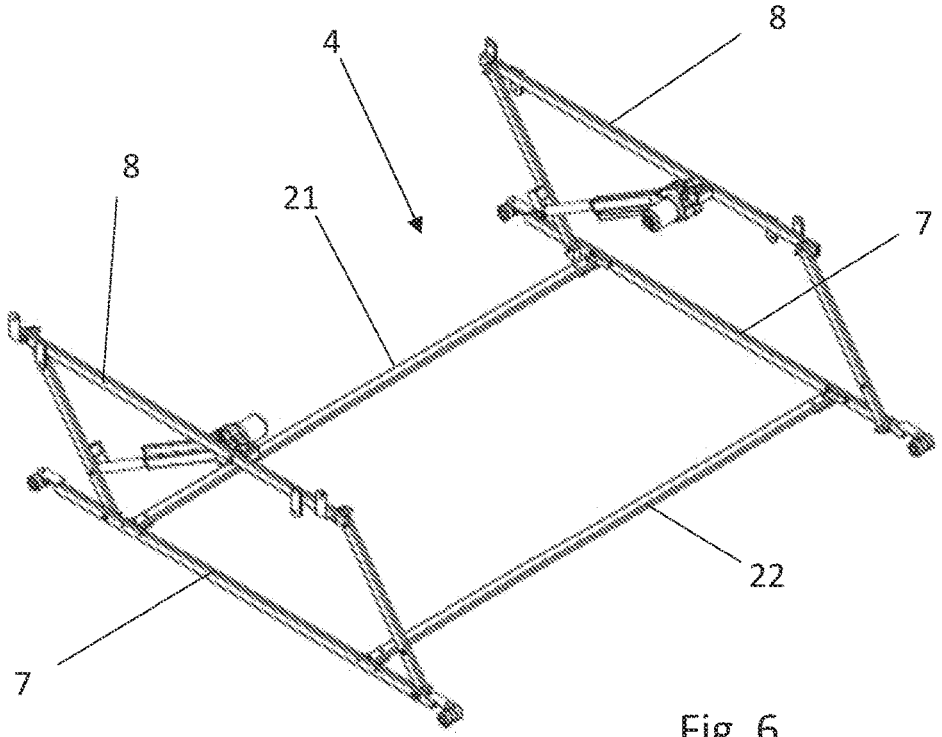
Figures 7A, 7B:
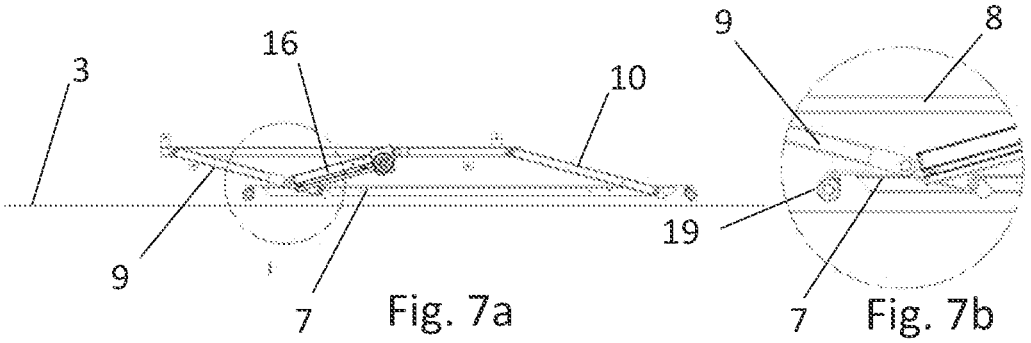
Figures 8A, 8B:
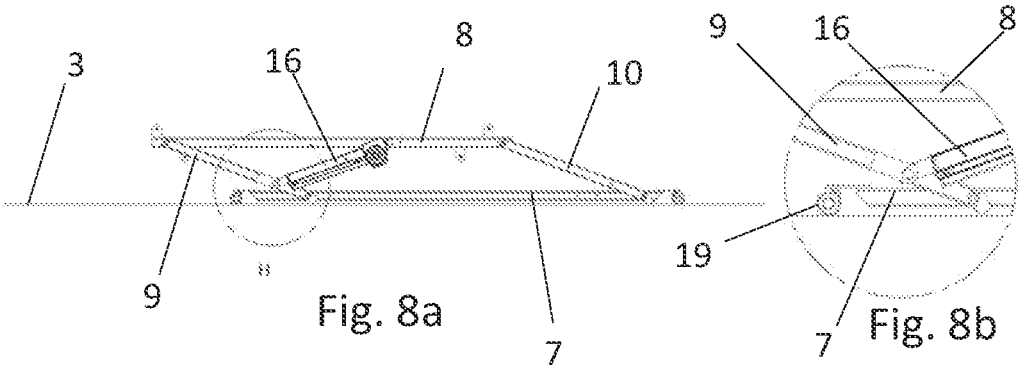
Figures 9A, 9B:
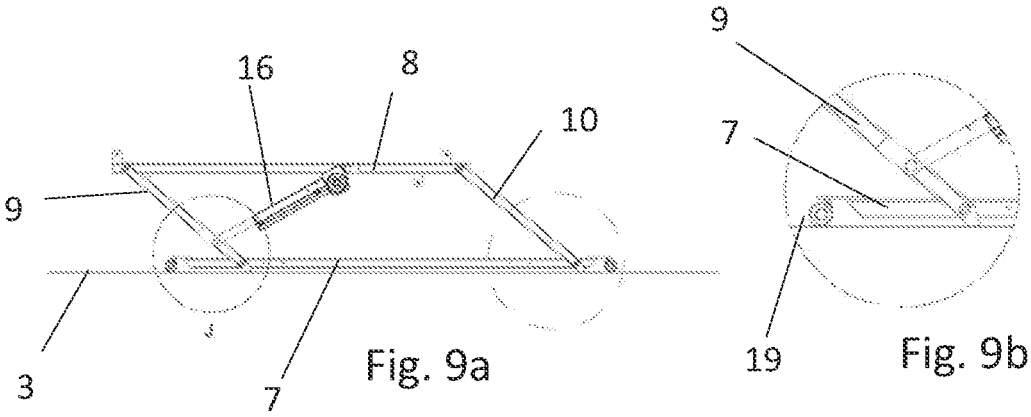
Figures 10A, 10B:
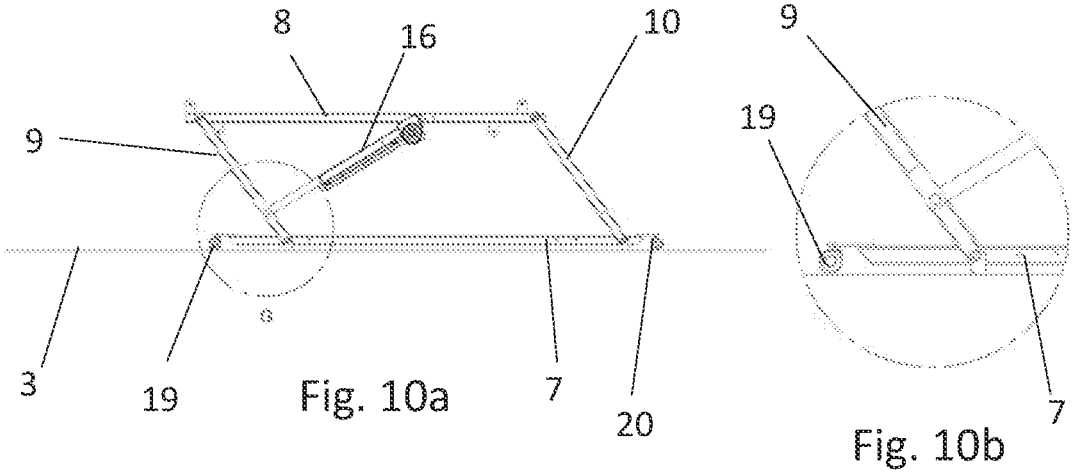
Figure 11:
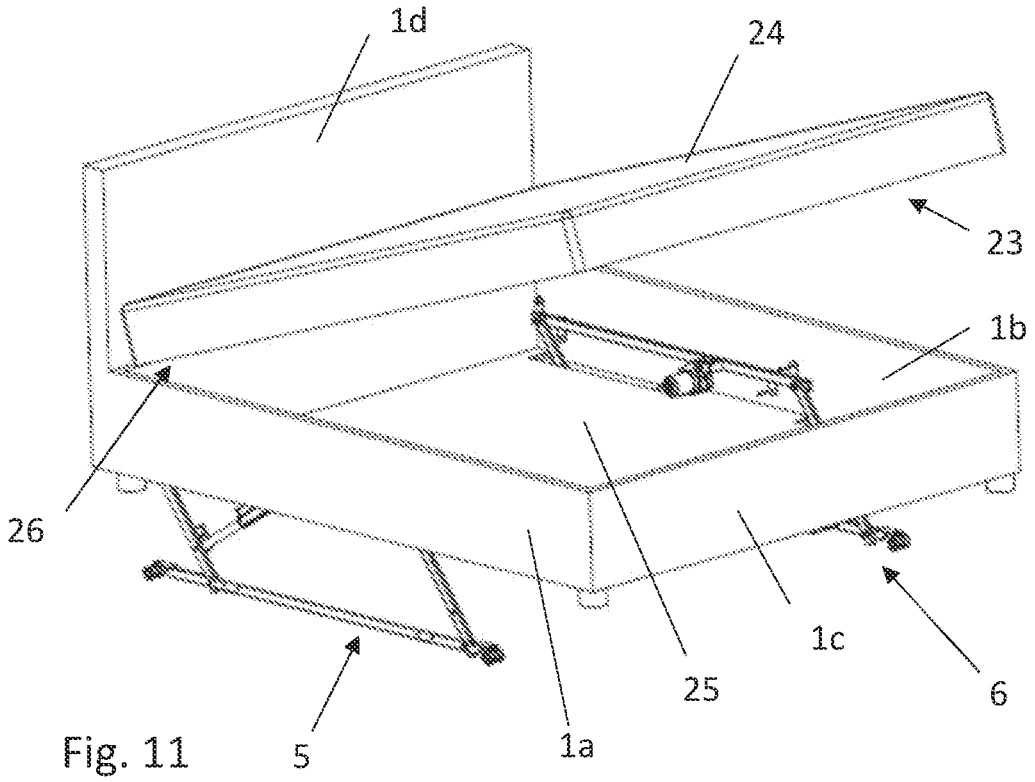
Figure 12:
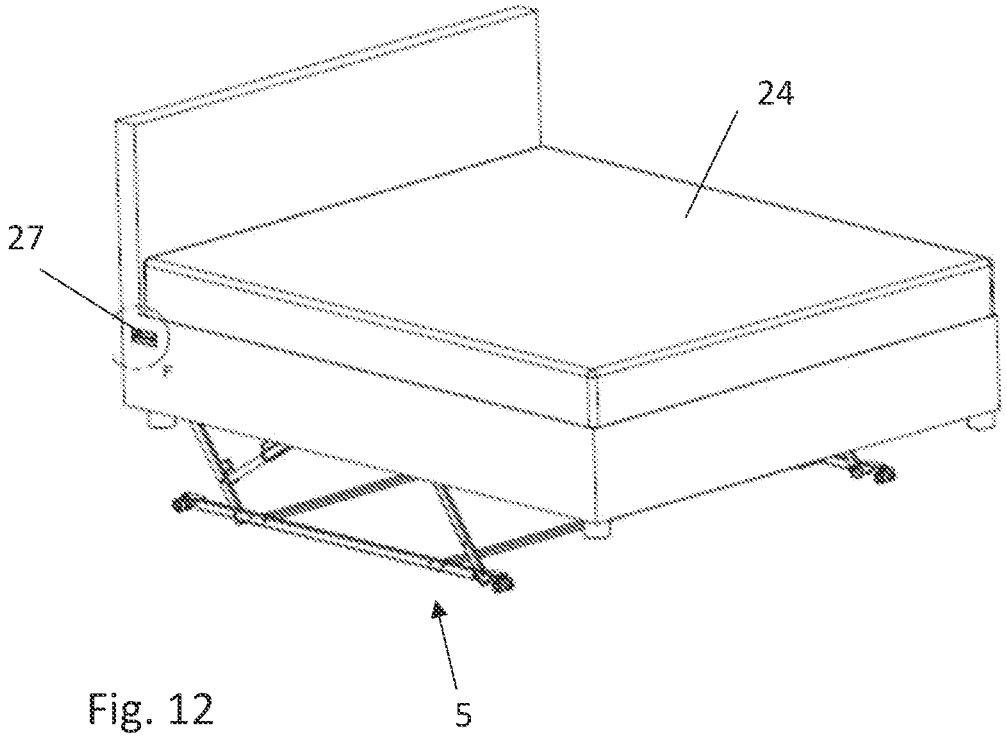
Figure 13:
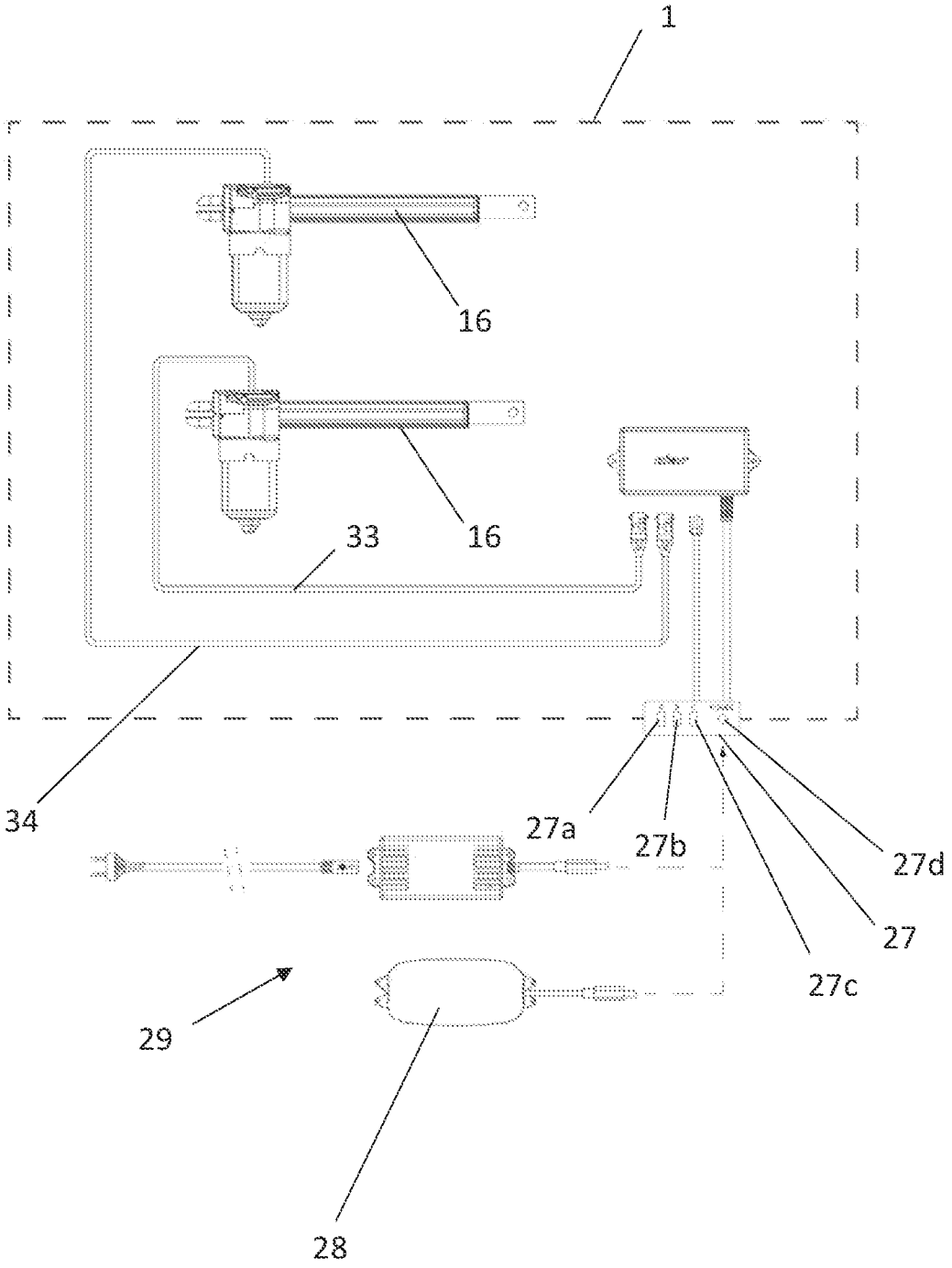
Figure 14:
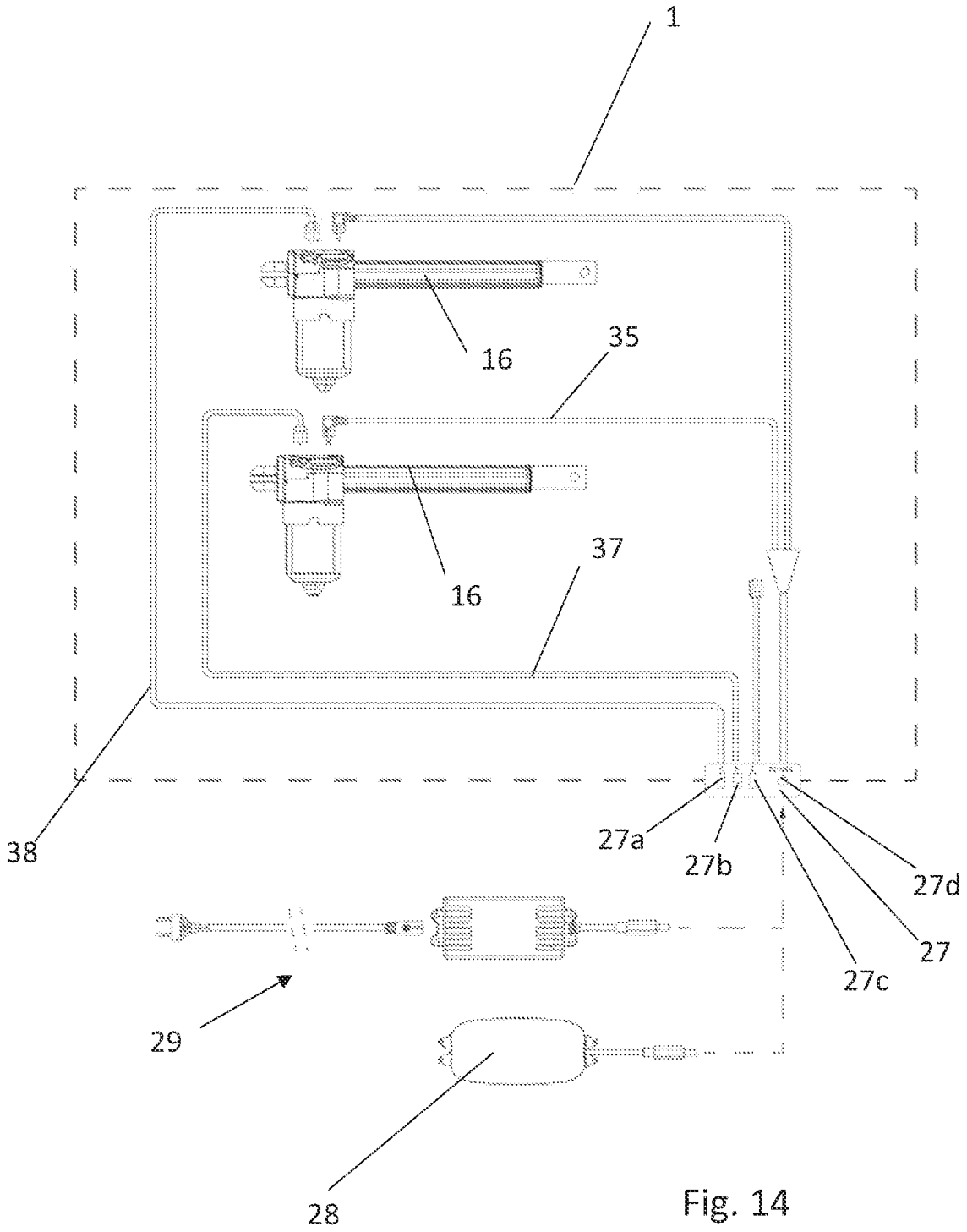

FIG. 4 shows a three-dimensional view of the bed according to the invention with a lifting device according to a first exemplary embodiment, FIG. 5 shows a side view of the pivot mechanism, FIG. 6 shows a three-dimensional representation of a lifting device according to a second exemplary embodiment, FIG. 7*a* shows a side view of the lifting device in the starting position, FIG. 7*b* shows a detailed view of the detail I of FIG. 7*a*, FIG. 8*a* shows a side view of the lifting device in the rolling position, FIG. 8*b* shows a detailed view of the detail H of FIG. 8*a*, FIG. 9*a* shows a side view of the lifting device in an intermediate position, FIG. 9*b* shows a detailed view of the detail J of FIG. 9*a*, FIG. 10*a* shows a side view of the lifting device in the high position, FIG. 10*b* shows a detailed view of the detail G of FIG. 10*a*, FIG. 11 shows a three-dimensional representation of a bed with mattress lifting device, FIG. 12 shows a three-dimensional representation of the bed with a switch panel, FIG. 13 shows an electrical circuit diagram for controlling the electric actuators according to a first variant, and FIG. 14 shows an electrical circuit diagram for controlling the electric actuators according to a second variant.

Figure 1:
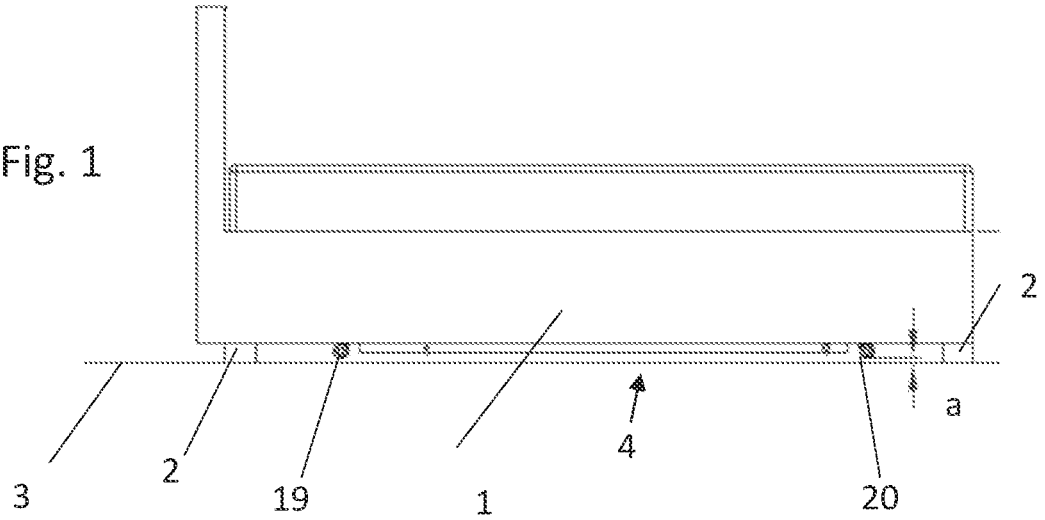
FIG. 1 shows is a side view of the bed in the starting position.
Figure 2:
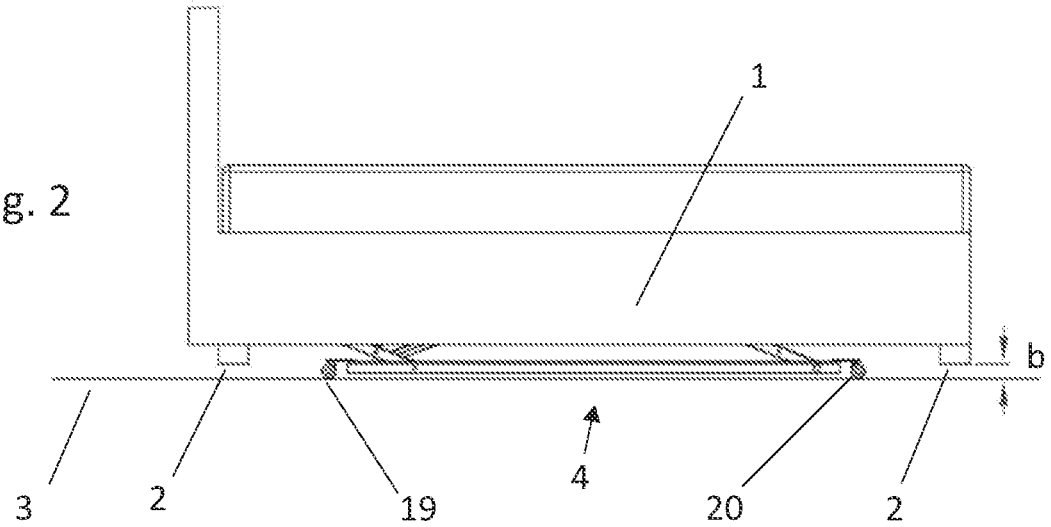
FIG. 2 shows a side view of the bed in the rolling position.
Figure 3:
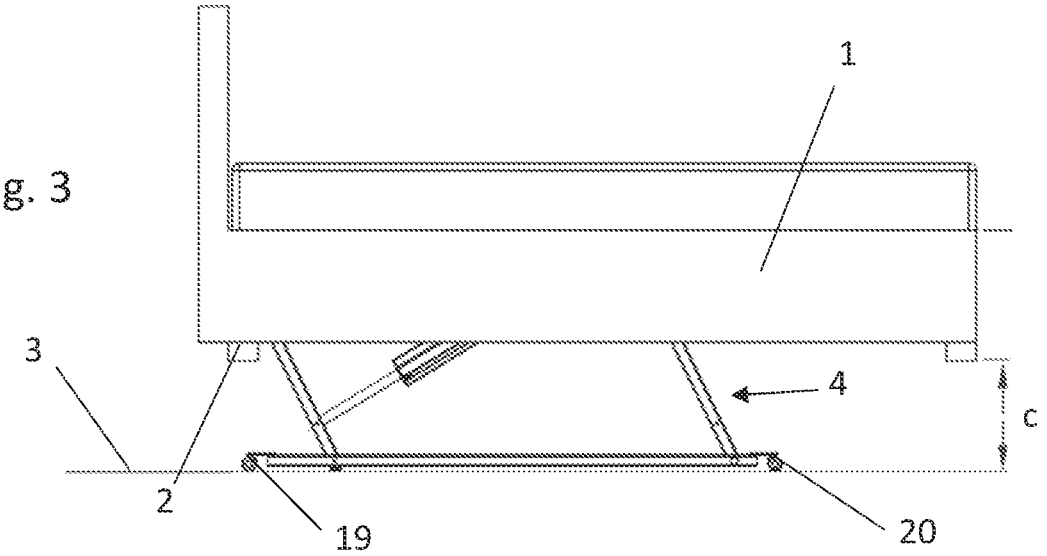
FIG. 3 shows a side view of the bed in the high position.

FIG. 1 shows a bed according to the invention with a bed frame 1 which, in the shown starting position of the bed, is supported on a standing surface 3 via bed legs 2. Furthermore, the bed has a lifting device 4 for lifting the bed between the starting position (FIG. 1) and a high position (FIG. 3). In the starting position, the lifting device 4 is spaced at a distance a from the standing surface 3. FIG. 2 shows a rolling position in which the lifting device is extended downward and has touched down on the standing surface 3 with wheels 19, 20, and the bed is already raised to such an extent that the bed legs have a distance b from the standing surface 3. In the high position according to FIG. 3, the bed is raised even further (distance c).

The bed frame 1 shown in FIG. 4 has two side parts 1*a*, 1*b*, a front part 1*c* and a rear part 1*b*. The lifting device 4 provides two separate, mirror-symmetrically designed pivot mechanisms 5, 6 which are fastened to opposing side parts 1*a*, 1*b* of the bed frame 1 and are described in more detail below with reference to FIG. 5.

The pivot mechanisms 5, 6 each have a lower frame part 7, an upper frame part 8 mounted on the bed frame 1, and two levers 9, 10 pivotably connected to the lower frame part 7 and the upper frame part 8, wherein the lower frame part 7, the upper frame part 8 and the two levers 9, 10 are pivotably connected to one another in the manner of a parallelogram mechanism. The upper frame part 8 is fastened by means of fastening tabs 11*a*, 11*b*, 11*c*, 11*d* to the bed frame 1 (side part 1*a* or 1*b*), for example, by means of screws. The lever 9 is pivotably connected to the upper frame part 8 at a first articulation point 12 and to the lower frame part 7 at a second articulation point. Similarly, the lever 10 is coupled to the upper frame part 8 at a third articulation point 14 and to the lower frame part 7 at a fourth articulation point.

The lifting device 4 comprises a respective electric actuator 16 for actuating the pivot mechanisms 5, 6, which electric actuator is designed here as an electric linear motor and is arranged between a fifth articulation point 17 in a central region of the lever 9 and a sixth articulation point 18 in a central region of the upper frame part 8.

The lower frame part 7 of the pivot mechanisms 4, 5 is equipped with wheels 19, 20 which are in rolling contact with the standing surface 3 in the rolling position of the lifting device 4 shown in FIG. 2, while the bed legs 2 are lifted off the standing surface 3.

The pivot mechanisms 5, 6 are designed such that the wheels 19, 20 are located at a distance from the standing surface 3 in the high position (FIGS. 3 and 5). For this purpose, the two levers 9, 10 of the two pivot mechanisms 5, 6 are connected to the lower frame part 7 at the second articulation point 13 or the fourth articulation point 15 such that an end region 9*a* of the lever 9 or an end region 10*a* of the lever 10, respectively, projects beyond the associated articulation point 13 or 15 and the length of these end regions 9*a*, 10*a* is dimensioned such that the bed is supported on the standing surface 3 via the end regions 9*a*, 10*a* in the high position (FIG. 5).

In the exemplary embodiment according to FIG. 6, the two lower frame parts 7 of the two pivot mechanisms 5, 6 are connected to one another via optional cross members 21, 22, whereby the lifting device 4 receives additional stability in the positions in which the bed legs 2 are lifted from the standing surface 3.

In FIGS. 7*a* to 10*b*, the pivoting mechanism 5 is shown in the starting position (FIG. 7*a*, 7*b*), the rolling position (FIG. 8*a*, 8*b*), an intermediate position (FIG. 9*a*, 9*b*) and the high position (FIG. 10*a*, 10*b*) in the side view and an enlarged detailed view, respectively. Starting from the starting position, the various positions are achieved by actuating the electric actuator 16 to increase the distance between the fifth and sixth articulation point 17, 18. The reverse adjustment from the high position to the starting position takes place by means of a reverse controlling of the electric actuator 16.

The position of the pivoting mechanism 5 according to FIGS. 7*a*, 7*b* corresponds to the starting position shown in FIG. 1 in which the pivoting mechanism 5 is located at a distance a above the standing surface 3. By actuating the electric actuator 16, the lower frame part 7 is first lowered together with the wheels 19, 20 in the direction of the standing surface 3 until the wheels touch down. Further actuation of the electric actuator 16 then results in a raising of the bed frame 1 together with the bed legs 2 to the rolling position, in which the entire bed is supported on the wheels 19, 20 (FIG. 2, FIGS. 8*a*, 8*b*).

If the electric actuator 16 is further actuated, the bed is raised further until the end regions 9*a*, 10*a* of the levers 9, 10 come into contact with the standing surface 3 in an intermediate position (FIG. 9*a*, 9*b*). Further actuation of the electric actuator 16 then causes the levers 9, 10 to be raised further in the vertical direction, with the end sections 9*a*, 10*a* causing the lower frame section 7 to be raised and thus the wheels 19, 20 to be lifted off the contact surface 3 (high position as shown in FIGS. 10*a*, 10*b*).

The bed frame is designed in the usual way for inserting a slatted frame 23 and a mattress 24. The two pivot mechanisms 5, 6 are each fastened below the mattress 24 on the inner side of the two side parts 1*a*, 1*b* on the bed frame 1 (FIG. 11), so that they are covered by the mattress 24. According to FIG. 11, the bed below the mattress 24 can optionally have a bed base 25 and a mattress lifting device 26 for lifting the mattress.

Although the pivot mechanisms 5, 6 in the exemplary embodiment shown in FIG. 1 are not completely covered by the bed frame 1, the two pivot mechanisms can also be designed and mounted so that they are completely covered by the bed frame 1 in the starting position.

The controlling of the electric actuators into the starting position, the rolling position and the high position can take place, for example, via a switch panel 27 provided in the region of the bed frame (FIG. 12).

FIG. 13 shows a first exemplary embodiment for controlling the two electric actuators 16. The switch panel 27 provided on the bed frame 1 provides a respective switch 27*a*, 27*b*, 27*c* for each of the three positions (FIGS. 1, 2, 3). Furthermore, a connection 27 *d* for connecting a power source (battery 28 or low-voltage transformer with mains plug 29) is provided in the region of the switch panel. A connection box 30 provided in the region of the bed frame 1 is connected via a power line 31 to the power source and via a control line 32 to the switches 27*a*, 27*b*, 27*c*. Furthermore, the two electric actuators 16 are connected to the connection box via lines 33, 34.

In the embodiment according to FIG. 14, the two actuators 16 are connected directly to the connection 27*d* on the switch panel 27 via separate power lines 35, 36. The control commands of the switches 27*a*, 27*b*, 27*c* are forwarded to the actuators 16 via control lines 37 and 38.

The invention claimed is:

1. A bed having a bed frame (1) which, in a starting position of the bed, is supported on a standing surface (3) via bed legs (2), and a lifting device (4) for lifting the bed between the starting position and a high position, wherein the lifting device (4) has pivot mechanisms (5, 6) arranged on opposing sides of the bed frame (1), which are each provided with a lower frame part (7), an upper frame part (8) mounted on the bed frame (1), and two levers (9, 10) pivotably connected to the lower frame part (7) and the upper frame part (8), wherein the lower frame part (7), the upper frame part (8) and the two levers (9,10) are pivotably connected to one another in the manner of a parallelogram mechanism, and the lifting device (4) comprises at least one electric actuator (16) for actuating the pivot mechanisms (5, 6), wherein:

the pivot mechanisms (5, 6) have no contact with the standing surface (3) in the starting position of the bed and are supported in the high position on the standing surface (3) and hold the bed frame (1) including the bed legs (2) at a distance from the standing surface (3), and the two levers (9, 10) of the two pivot mechanisms (5, 6) are each connected to the lower frame part (7) at an associated articulation point (13, 15) such that one end region (9*a*, 10*a*) of each of the levers (9, 10) protrudes beyond the associated articulation point (13, 15) and the length of these end regions (9*a*, 10*a*) is dimensioned so that the end regions (9*a*, 10*a*) contact the standing surface below the articulation point and the bed is supported on the standing surface (3) via the end regions (9*a*, 10*a*) of the levers (9, 10) in the high position.

2. The bed according to claim 1, characterized in that the lower frame part (7) of the pivot mechanisms (5, 6) is equipped with wheels (19, 20) which are in rolling contact with the standing surface (3) in a rolling position of the lifting device (4), while the bed legs (2) are lifted from the standing surface (3).

3. The bed according to claim 2, characterized in that the pivot mechanisms (5, 6) are designed such that the wheels (19, 20) are located at a distance from the standing surface (3) in the high position.

4. The bed according to claim 1, characterized in that the bed frame (1) is designed for inserting a slatted frame (23).

5. The bed according to claim 1, characterized in that the bed frame (1) is designed for inserting a mattress (24) and the pivot mechanisms (5, 6) are fastened to the bed frame (1) below the mattress (24).

6. The bed according to claim 5, characterized in that the bed has a bed base (25) below the mattress (24) and a mattress lifting device (26) is provided for lifting the mattress (24).

7. The bed according to claim 1, characterized in that, in the starting position of the bed, the two pivot mechanisms (5, 6) are completely covered by the bed frame (1) in the side view.

8. The bed according to claim 1, characterized in that the two lower frame parts (7) of the two pivot mechanisms (5, 6) are connected to one another via cross members (21, 22).

9. The bed according to claim 1, characterized in that the electric actuator (16) is designed as an electric linear motor which is arranged between one of the two levers (9, 10) and the lower or upper frame part (7, 8).

10. The bed according to claim 1, characterized in that each of the two pivot mechanisms (5, 6) is equipped with an electric actuator (16).

11. The bed according to claim 1, characterized in that at least one switch (27*a*, 27*b*, 27*c*) for controlling the at least one electric actuator (16) is provided on the bed.

12. The bed according to claim 11, characterized in that a connection (27*d*) for connecting a power source (28, 29) is provided proximate the at least one switch (27*a*, 27*b*, 27*c*).

* * * * *